US009539591B2

(12) United States Patent
Raab et al.

(10) Patent No.: US 9,539,591 B2
(45) Date of Patent: Jan. 10, 2017

(54) SHOWER HEAD

(75) Inventors: Stefan Raab, Cologne (DE); Stefan Bruckmann, Dortmund (DE)

(73) Assignee: ROOF GROOVE PUBLISHING S.À.R.L., Geneva (CH)

( * ) Notice: Subject to any disclaimer, the term of this patent is extended or adjusted under 35 U.S.C. 154(b) by 731 days.

(21) Appl. No.: 13/509,348

(22) PCT Filed: Sep. 30, 2010

(86) PCT No.: PCT/EP2010/064566

§ 371 (c)(1),
(2), (4) Date: Sep. 24, 2012

(87) PCT Pub. No.: WO2011/057859

PCT Pub. Date: May 19, 2011

(65) Prior Publication Data

US 2013/0015272 A1 Jan. 17, 2013

(30) Foreign Application Priority Data

Nov. 11, 2009 (DE) ..... 10 2009 046 632

(51) Int. Cl.
*B05B 1/04* (2006.01)
*B05B 1/16* (2006.01)
(Continued)

(52) U.S. Cl.
CPC ..... *B05B 1/18* (2013.01); *B05B 1/1618* (2013.01); *B05B 1/1636* (2013.01); *B05B 1/04* (2013.01);
(Continued)

(58) Field of Classification Search
CPC ..... A62C 31/00; A62C 37/20; B05B 1/14; B05B 1/18; B05B 1/1636; B05B 1/1645; B05B 1/1654; B05B 1/32; B05B 1/04; B05B 1/046; B05B 7/061; E03C 1/0405; F23D 14/583
(Continued)

(56) References Cited

U.S. PATENT DOCUMENTS 870,766 A * 11/1907 Eaton ..... A01K 13/001 119/671
3,858,252 A * 1/1975 Ejchorszt ..... B05B 1/207 239/282
(Continued)

FOREIGN PATENT DOCUMENTS

DE 03600322 A1 9/1987
DE 19942853 A1 4/2001
(Continued)

OTHER PUBLICATIONS

International Preliminary Report on Patentability mailed on Jul. 3, 2012 for International Application No. PCT/EP2010/064566.
(Continued)

*Primary Examiner* — Arthur O Hall
*Assistant Examiner* — Christopher R Dandridge
(74) *Attorney, Agent, or Firm* — Richard M. Klein; Fay Sharpe LLP

(57) ABSTRACT

The invention relates to a shower head having a rigid housing (1), having a connection for a water line (4) and at least one water transport channel which can be connected to the water line (4) and which ends in nozzles which are arranged on the side of the housing (1) pointing down when in use and through which water streams emerge, wherein the housing (1) has an elongated, flat shape. The aim of the invention is to develop a simple and cost-effectively produced shower head which generates a concentrated water stream and also generates a broad water curtain. Said aim is achieved in that the nozzles are substantially distributed over
(Continued)

the entire length of the housing (1) and a manually activated shut-off device is combined with the shower head by means of which the water stream to one part of the nozzle (6) can be interrupted.

12 Claims, 7 Drawing Sheets

(51) Int. Cl.

| | |
|---|---|
| ***B05B 7/06*** | (2006.01) |
| ***E03C 1/04*** | (2006.01) |
| ***F23D 14/58*** | (2006.01) |
| ***B05B 1/18*** | (2006.01) |
| *B05B 1/14* | (2006.01) |
| *B05B 1/32* | (2006.01) |
| *B05B 1/20* | (2006.01) |

(52) U.S. Cl.
CPC ..... *B05B 1/046* (2013.01); *B05B 1/14* (2013.01); *B05B 1/1645* (2013.01); *B05B 1/1654* (2013.01); *B05B 1/205* (2013.01); *B05B 1/32* (2013.01); *B05B 7/061* (2013.01); *E03C 1/0405* (2013.01); *F23D 14/583* (2013.01)

(58) Field of Classification Search
USPC ..... 239/447, 548, 553.5, 556, 562, 567, 568,239/536, 448, 449
See application file for complete search history.

(56) References Cited

U.S. PATENT DOCUMENTS

| | | | | |
|---|---|---|---|---|
| 4,927,083 | A * | 5/1990 | Daunt | B05B 1/207 239/282 |
| 5,109,553 | A | 5/1992 | Kishimoto | |
| 5,918,811 | A * | 7/1999 | Denham | B05B 1/08 239/123 |
| 5,979,800 | A * | 11/1999 | Takagi | 239/440 |
| 6,227,456 | B1 * | 5/2001 | Colman | 239/1 |
| 6,230,989 | B1 * | 5/2001 | Haverstraw | B05B 1/044 239/443 |
| 6,454,186 | B2 * | 9/2002 | Haverstraw et al. | 239/443 |
| 6,550,697 | B2 * | 4/2003 | Lai | 239/446 |
| 6,622,945 | B1 * | 9/2003 | Wu et al. | 239/443 |
| 6,742,725 | B1 | 6/2004 | Fan | |
| 7,344,095 | B1 * | 3/2008 | Hsu | B05B 1/1618 239/444 |
| 7,360,723 | B2 * | 4/2008 | Lev | B05B 1/16 239/442 |
| 7,665,676 | B2 * | 2/2010 | Lev | B05B 1/16 239/442 |
| 7,789,326 | B2 * | 9/2010 | Luettgen et al. | 239/447 |
| D652,104 | S | 1/2012 | Raab | |
| 8,292,200 | B2 * | 10/2012 | Macan et al. | 239/463 |

FOREIGN PATENT DOCUMENTS

| | | | |
|---|---|---|---|
| DE | 200 21 008 | U1 | 9/2001 |
| DE | 101 08 615 | A1 | 9/2002 |
| DE | 202 12 727 | U1 | 1/2003 |
| DE | 202004005511 | U1 | 9/2004 |
| JP | H03201919 | | 9/1991 |
| JP | H08103690 | | 4/1996 |
| JP | H08140881 | | 6/1996 |
| JP | 2009189607 | | 8/2009 |
| WO | WO0228540 | A1 | 4/2002 |
| WO | WO2004016142 | A1 | 2/2004 |
| WO | WO 2007/026153 | A1 | 3/2007 |
| WO | WO-2009/023391 | A1 | 2/2009 |
| WO | WO2009023391 | A1 | 2/2009 |

OTHER PUBLICATIONS

Japanese Office Action for corresponding Application No. JP 2012-538257; dated Mar. 29, 2013.
Japanese Office Action for corresponding Application No. JP 2012-538257; dated Sep. 28, 2012.

* cited by examiner

Fig.1
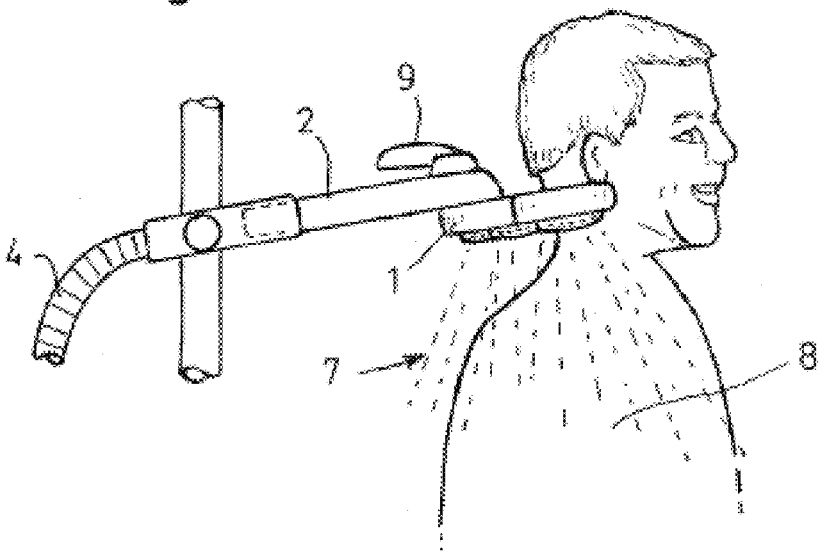
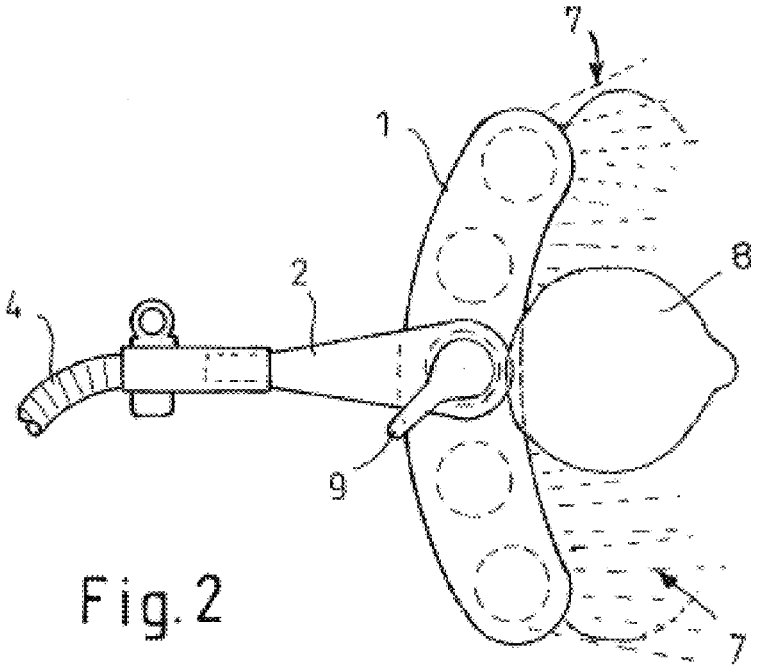
Fig.2

Fig.9
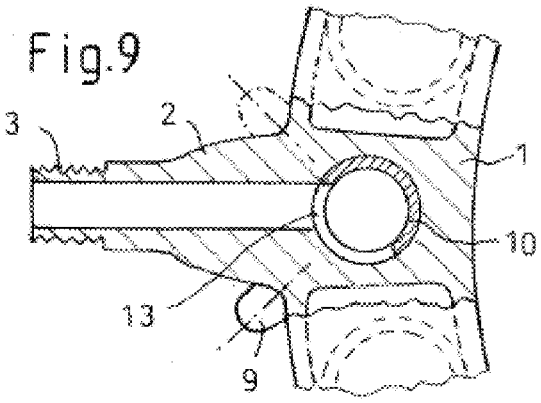
Fig.10
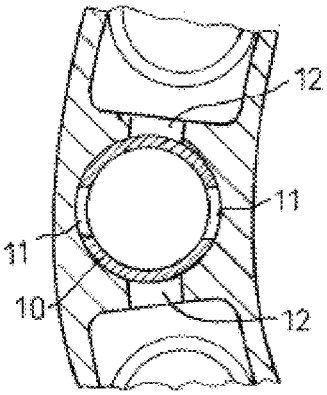
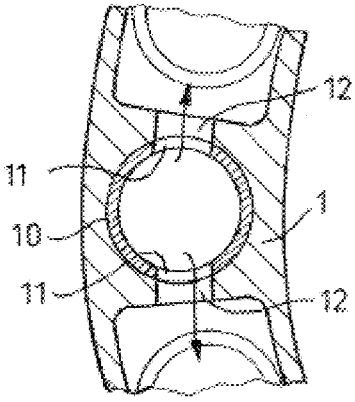
Fig.12
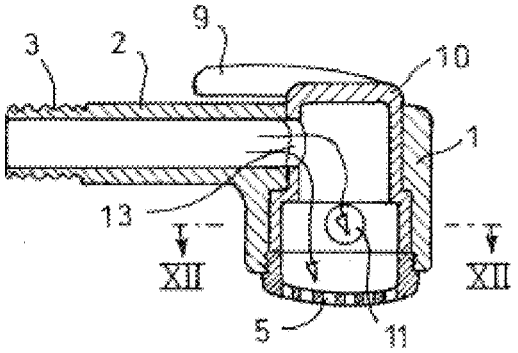
Fig.11

SHOWER HEAD

CROSS-REFERENCE TO RELATED APPLICATIONS

This application is the U.S. National Stage of PCT Application No. PCT/EP2010/064566, filed Sep. 20, 2010, which claims priority benefits to German Patent Application No. 10 2009 046 632.0, filed Nov. 11, 2009.

BACKGROUND

The invention relates to shower heads with a rigid housing.

Shower heads with a jet form which differs from the conventional water jet of round cross section are known, for example, from WO 02/28540 A1. The shower head illustrated in FIG. 3 of said document, also referred to as a dual shower attachment, has a length of approximately 30 cm and a width of approximately 6 cm. The height is approximately 2 cm, thus resulting in a rigid flat housing with inner water flow channels. A shower plate is arranged at each of the two ends of the housing, thus resulting in a dual shower with two individual jets spaced apart from one another. This measure achieves better distribution of the water over the body of the person who is taking a shower. However, the greater number of nozzles in comparison with conventional shower heads reduces the intensity of the exiting water jet.

A shower head which allows good water distribution and an intense water jet is known from DE 202 12 727 U1. The shower head comprises two shower-head parts which can be pivoted in relation to one another. Each shower-head part has a set of nozzles. The first set of nozzles is oriented downward when the shower-head parts have been pivoted into a position in which they are adjacent to one another. In this pivoting position, a circular water jet exits from this shower head. The second set of nozzles is located on the elongate portion of the two pivotable shower-head parts. A water curtain exits through these nozzles when the shower-head parts have been pivoted apart from one another, so as to extend in the horizontal direction. The water curtain follows a curved line and may be located in the shoulder region of the person who is taking a shower, and therefore the person who is taking a shower is sprayed uniformly with water without the exiting water making his hair wet. The articulation for the shower-head parts is designed as a rotary valve, which directs the water, in the first pivoting position, to the first-mentioned set of nozzles and, in the second pivoting position, to the second-mentioned set of nozzles. This shower head is very complex and costly to produce.

BRIEF SUMMARY OF THE INVENTION

It is an object of the invention to develop a shower head which is simple and cost-effective to produce and generates, on the one hand, a concentrated water jet and, on the other hand, an extensive water curtain.

This object is achieved according to the invention by a shower head with a rigid housing, which has a connection for a water line and at least one water flow channel, which can be connected to the water line and opens out into nozzles, which are arranged on that side of the housing which is oriented downward during use and have water jets exiting through them, wherein the housing has an elongate flat shape, is developed in that the nozzles are distributed essentially over the entire length of the housing, and the shower head is assigned a manually actuable shut-off device, by means of which it is possible to interrupt the flow of water to some of the nozzles.

When the nozzles are fully open, a gentle water curtain is distributed, not just at certain points, but over the entire underside of the shower head, and sprays onto the shoulders of the person who is taking a shower. If the shower head is arranged a little way above the shoulders, the hair does not become wet from the exiting water. The water flows only onto the shoulders and the back region.

If, in contrast, some of the nozzles are shut off by means of the manual shut-off device, the pressure and the quantity of the water flowing out increases in those nozzles which remain open. This gives rise to a more intense water jet, referred to hereinbelow as rinsing jet. The rinsing jet is harder and more concentrated than the water curtain, when the nozzles are fully open, and is thus highly suitable for rinsing the hair or for rinsing off soap.

The shower head performs the same tasks as the shower head which is known from DE 202 12 727 U1. However—apart from the shut-off device for the lateral nozzles—it does not have any movable elements, in particular any pivotable shower-head parts. The shower head can be produced as a simple plastics-material or metal housing made of two interconnected shells. The water channel which leads from the connection for the water line to the nozzles is formed here by the cavity within the housing. Such a shower head is simple and cost-effective to produce.

In practice, the nozzles may be arranged along a curved center line. In particular, the elongate housing itself, as seen from beneath, may have a curved center line. The elongate housing extends, during use, essentially parallel to the surface of the user's back, and thus usually parallel to the shower wall located behind the user. The curvature of the elongate housing, as seen by the person who is taking a shower, is concave. This means that the ends of the elongate housing are curved in the direction of the user. In this way, the elongate housing extends essentially over a portion of a ring. The user thus stands beneath the elongate housing such that his neck is located in the region of the center of the housing, wherein the two ends of the housing extend over the user's shoulders. A water curtain then exits from the housing along a circle portion and sprays, in the center, onto the user's neck and back and, at the lateral ends, onto the user's shoulders.

It is preferable for the nozzles which are remote from the center of the housing to be designed in a closable mariner and for the central nozzles to be designed such that they cannot be closed. In other words, the shut-off device, in a first switching position, releases the flow of water to all the nozzles and, in a second switching position, interrupts the flow of water to the nozzles which are remote from the center of the housing. When the lateral nozzles are closed, the rinsing jet then exits symmetrically in relation to the center of the housing. This is advantageous, in particular, in embodiments in which the fastening means of the housing is arranged in the center. Since the rinsing jet exits symmetrically in relation to the housing center, it does not generate any torque around the fastening means and cannot rotate the housing. Moreover, the user's head is located centrally between his shoulders, and therefore, when switching over to the rinsing jet by shutting off the lateral nozzles of the shower head, the user need not change his position if he wishes to wash his haft and, for this purpose, directs the rinsing jet onto his head.

In practice, the shower head may have at least two flow cross sections. The water flows through a first flow cross section to the nozzles which are arranged in the center of the housing. The water flows through a second flow cross section to the nozzles which are remote from the center of the housing. The shut-off device, in the second switching position, closes the second flow cross section.

In the first switching position, the shut-off device can partially close the first flow cross section and release the second flow cross section. The water is directed to the lateral regions of the shower head, in practice, through smaller flow cross sections than it is directed to the central region of the shower head. A partial closure of the first flow cross section throttles the flow to the central nozzles somewhat, so as to produce a very uniform and homogenous shower jet over the entire width of the shower head.

In practice, the shut-off device may have a contact slide which can be displaced counter to a return spring and, in the case of the contact slide being subjected to a first push, remains in a first latching position and, in the case of the contact slide being subjected to a second push, remains in a second latching position, wherein the contact slide, in its first latching position, moves the shut-off device into the first switching position thereof and, in its second latching position, moves the shut-off device into the second switching position thereof. The contact slide, in a manner similar to the actuating knob of a ballpoint pen, can latch into two positions via a latching mechanism. Simply by pushing on the contact slide, it is possible to switch over between the two switching positions of the shut-off device. This is simple and is also possible with wet fingers.

The connection for the water line may likewise be arranged in the center of the shower head. In a practical embodiment, the connection for the water line is a connector provided with an external thread, wherein the external thread serves, at the same time, as fastening means of the housing.

In practice, the number of nozzles which are arranged in the center of the housing may be greater, per unit of surface area, than the number of nozzles which are remote from the center of the housing. When soap or shampoo is being showered off, the higher number of nozzles in the center of the shower head generates a particularly intense water jet.

In a practical embodiment, the underside of the shower head has a plurality of diffusers which are arranged along the center line of the housing and each have a plurality of through holes which form the nozzles. The diffusers are produced as standard components for conventional shower heads. They can be accommodated in the underside of the housing of the shower head according to the invention and thus form a plurality of, for example five, water jets located one beside the other.

The diffusers preferably each generate a conically diverging water jet made up of a plurality of individual jets. Each diffuser on the underside of the housing may be designed convexly for this purpose, wherein one nozzle in the center generates a jet which runs essentially perpendicularly to the plane of the housing and the other nozzles, as the distance thereof from the center of the diffuser increases, are inclined to an increasing extent in relation to the vertical onto the underside of the housing. Consequently, the outer nozzles emit the water in jets obliquely outward. The result, for each diffuser, is a water jet which is fanned out conically. For example, five diffusers may be arranged on the underside of the housing along the curved center line of the housing. At a short distance from the underside of the housing, e.g. at a distance of 10 to 20 cm, the jets of adjacent diffusers run into one another and form a closed water curtain.

In order to shut off the outer nozzles, a simple slide can shut off the water flow channel which leads to the outer nozzles. In the region of the circumference of a central diffuser, an annular shut-off slide may be arranged in a rotatable manner in the shower head. In a first rotary position, the shut-off slide releases a through-passage to the outwardly leading water flow channels. In a second rotary position, the shut-off slide shuts off these water flow channels and no water exits from the outer diffusers. In this second position, the shower head functions like a simple hand-held shower head, in the case of which the water exits through a single diffuser in the center of the shower head.

The slide may be manually operable in practice. For example, movable operating elements which are coupled to the slide may project out of the housing of the shower head. Depending on the desired functioning mode, the user can displace the operating elements into a first end position, in which the supply flow to the outer nozzles is released, or into a second end position, which is located opposite the first end position and in which the supply flow to the outer nozzles is shut off. It is also possible for the slide to be formed onto the periphery of the central diffuser. The central diffuser may have a periphery which extends along a cylinder surface, projects into the housing and has two windows located opposite one another. These windows, in a first rotary position, are aligned with the outwardly leading water flow channels. In this rotary position, water flows from the connection to all the diffusers. In a second rotary position, the outwardly leading water flow channels are blocked by the cylindrical peripheries, and the water exits only through the central diffuser. In order for the periphery of the central diffuser to be rotated, the central diffuser is fastened in a rotatable manner on the housing.

The housing may be a very flat design in practice. It is also possible for a connector, which is located on the housing and forms the connection for the water line and possibly the fastening means of the housing, to be inclined only to a very slight extent in relation to the plane of the housing. This means that the housing lends itself well to stacking and can be stored in a space-saving manner. It is also possible, however, for the shower head with flat housing to be placed in a space-saving manner in a suitcase or a bag and thus to be used, for example, for traveling.

BRIEF DESCRIPTION OF THE DRAWINGS

Exemplary embodiments of the invention will be explained hereinbelow with reference to the attached drawings.

FIG. 1 shows a side view of the shower head during use.

FIG. 2 shows a plan view of the shower head during use.

FIG. 9 shows an illustration of the shower head in section along section line IX-IX in FIG. 8.

FIG. 10 shows an illustration of the shower head in the rinsing position and in section along section line X-X in FIG. 8.

FIG. 11 shows an illustration, corresponding to FIG. 8, of the shower head in the showering position.

FIG. 12 shows an illustration of the shower head from FIG. 11 in section along section line XII-XII.

DETAILED DESCRIPTION

Figure 3:
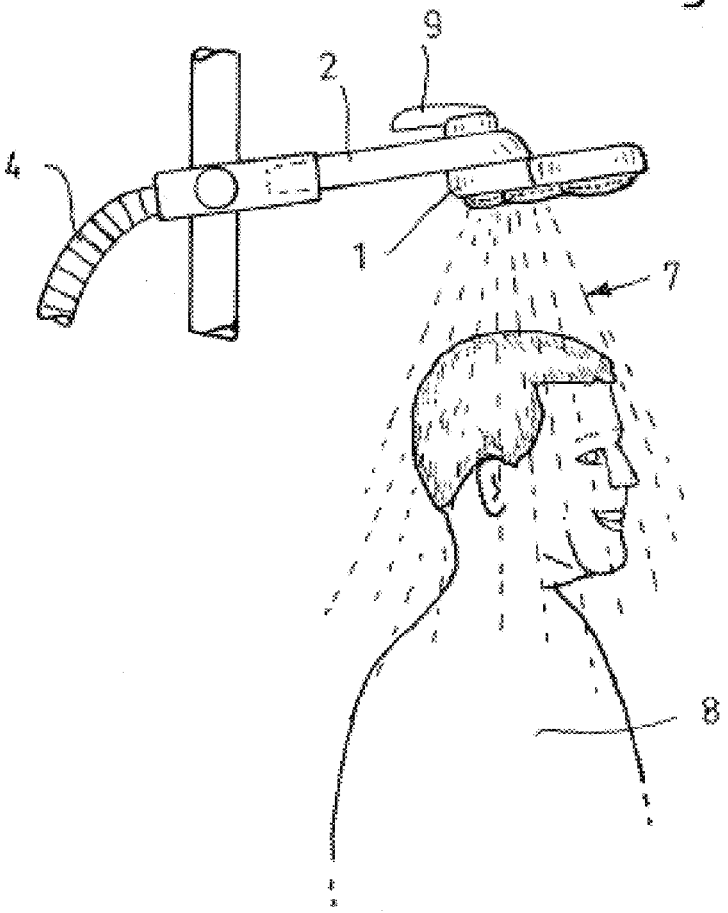
FIG. 3 shows a side view of the shower head during rinsing operation.
Figure 4:
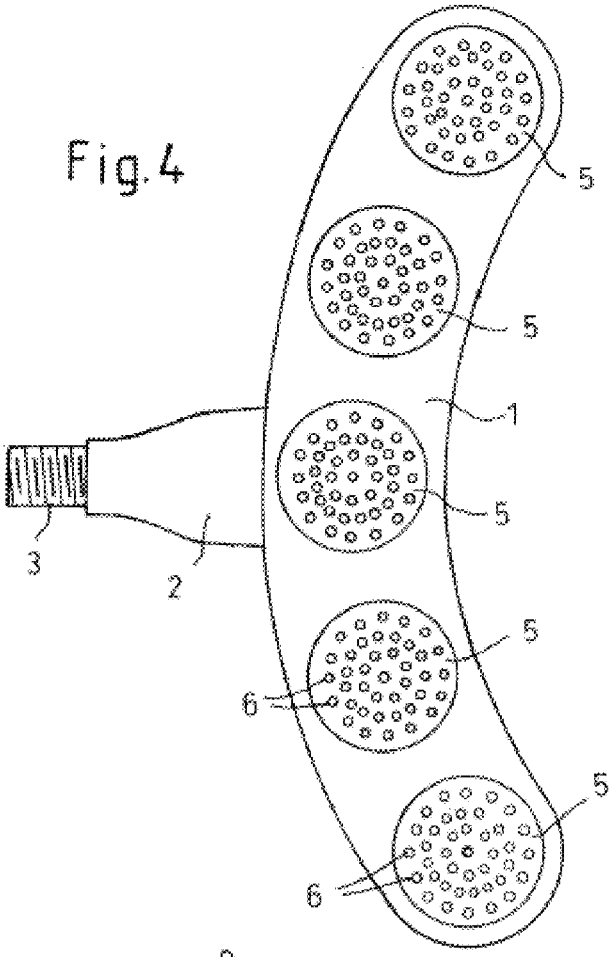
FIG. 4 shows a bottom view of the shower head.

As can be seen, in particular, in FIG. 4, the shower head comprises an elongate housing 1, of which the center line extends along a circle. A tubular connector 2 is arranged on the housing 1 and has its free end provided with an external thread 3. The external thread 3 serves for fastening on a water line 4 (see FIGS. 1 to 3). The hollow connector 2 directs the water from the water line 4 to the interior of the housing 1. The housing 1 can expediently be produced by plastics injection molding.

Figure 5:
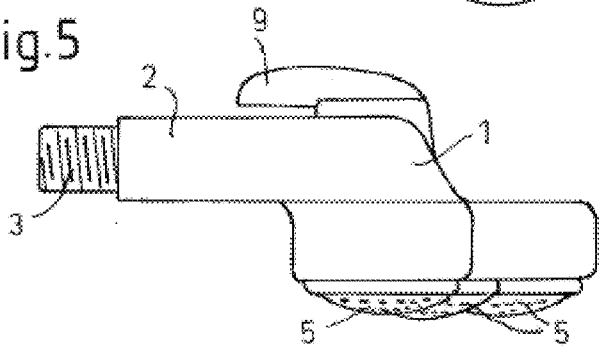
FIG. 5 shows a side view of the shower head.
Figure 6:
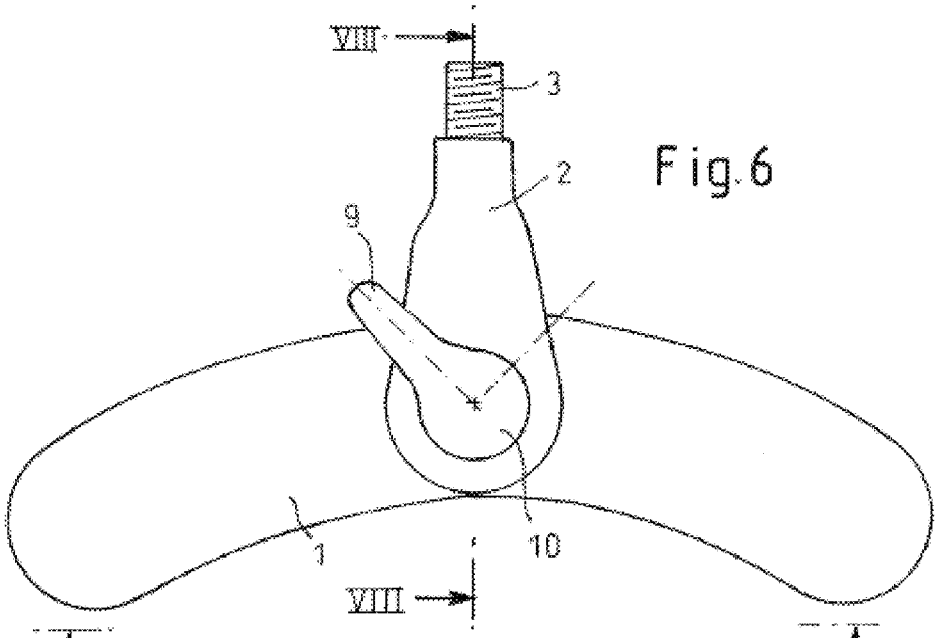
FIG. 6 shows a plan view of the shower head.
Figure 7:
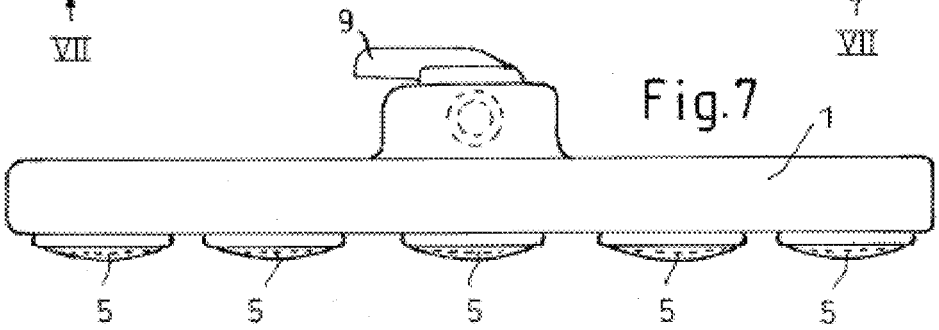
FIG. 7 shows a front view of the shower head.

Five diffusers 5 are arranged on the underside of the housing 1, these having a multiplicity of through holes which form nozzles 6 for the exit of water. As can be seen, in particular, in FIG. 5, the diffusers 5 are of convex design, and therefore they generate a conical water jet 7. FIG. 4 shows that the diffusers 5 extend essentially over the entire length of the elongate, curved housing 1. The diameter of the diffusers 5 is only slightly smaller than the width of the housing 1. If all the diffusers 5 are active, the shower head according to the invention generates a water curtain which extends over the entire surface area of the curved housing 1. On account of the conical water jet of each diffuser, the water jets of the individual diffusers 5 come together at a small distance from the underside of the shower head, a closed water curtain being formed as a result. This can be seen, for example, in FIGS. 1 and 2. The person 8 who is taking a shower arranges the shower head according to the invention preferably in the region of his neck, and therefore the water curtain sprays onto the neck and the shoulders of the person 8 who is taking a shower (FIGS. 1 and 2), but his hair remains dry.

A manually actuable lever 9, which forms part of a shut-off device, is arranged on the upper side of the shower head. The shut-off device has a bell 10, which is fixed to the lever 9 and is accommodated in a rotatable manner in the housing 1. The bell 10 forms an annular shut-off slide for the water flowing to the lateral diffusers 5. A first switching position releases the flow of water to all the nozzles. This switching position is illustrated in FIGS. 11 and 12. The bell 10 has windows 11, which are located opposite one another and, in this first switching position, are aligned with through-channels 12 which are arranged in that wall of the housing 1 which encloses the bell 10. Water flowing into the bell can flow into the lateral regions of the housing 1 through the windows 11 and through the through-channels 12 and can exit from all the diffusers 5 over the entire length of the shower head.

The resulting water curtain is illustrated in FIGS. 1 and 2.

The water flowing in flows through an inflow opening 13 in the upper region of the bell 10. The inflow opening 13 extends over an angular region of approximately 90° and, in any desired rotary position of the bell 10 between two switching positions which are offset through 90° in relation to one another, releases the through-passage for the water from the interior of the connector 2 into the interior of the bell 10.

Figure 8:
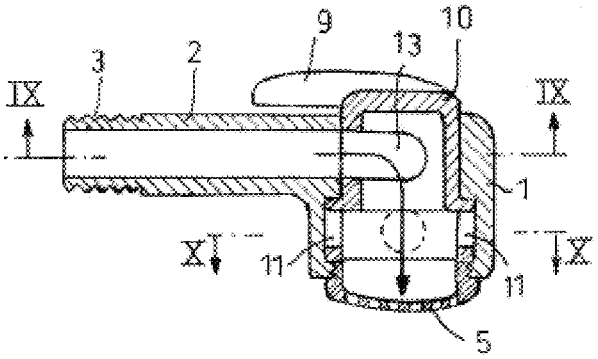
FIG. 8 shows an illustration which has been sectioned along section line VIII-VIII in FIG. 6 and in which the shut-off device is in the rinsing position.
Figure 13:
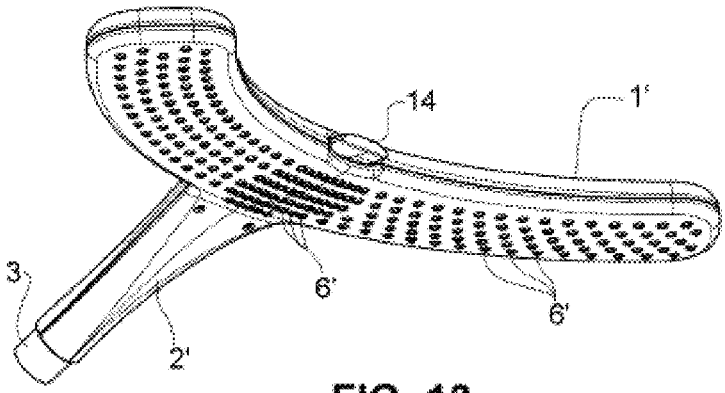
FIG. 13 shows a three-dimensional view of a further embodiment of a shower head.

The second rotary position of the bell 10 is illustrated in FIGS. 8 and 10. Here, the windows 11 have been rotated through 90° in relation to the through-channels 12. The wall of the bell 10 blocks the throughflow of the water into the lateral regions of the housing 1. As can be seen in FIG. 8, in this rotary position of the bell 10, the water can exit exclusively through the central diffuser 5, which is located directly beneath the bell 10. In this rotary position of the bell 10, the central diffuser 5 is subjected to the total pressure of the water in the water line 4. A rinsing jet, which can be seen in FIG. 3, exits from the central diffuser 5. This rinsing jet is more intense than the water curtain, which is produced when the water exits through all the diffusers 5.

It should be noted that the shut-off device, which is illustrated in particular in FIGS. 8 to 12, merely constitutes an example. Any other desired embodiments of such shut-off devices are conceivable. For example, it is possible to use slides which shut off through openings for water which flows to the lateral diffusers. It is likewise possible for the bell 10 to be produced in one piece with the diffuser 5, and therefore the lateral diffusers can be shut off simply by virtue of the diffuser 5 being rotated. Any other desired shut-off mechanisms on the housing 1, or in the vicinity thereof, can be used for shutting off the inflow of water into the lateral diffusers. The shut-off devices may advantageously be designed such that only one grip is necessary to switch over between the two switching positions of the shut-off device.

FIGS. 13 to 17 show a further embodiment of a shower head according to the invention.

The housing 1' here is produced by plastics injection molding. It comprises a plurality of housing shells, which are glued or screwed to one another. The lower shell of the housing 1' has the nozzles 6'. These can be introduced into the hard housing shell by 2-component injection molding using rubbery plastics material.

Figure 14:
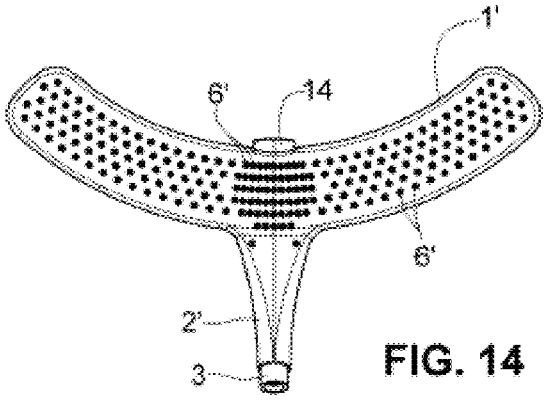
FIG. 14 shows a bottom view of the shower head from FIG. 13.

It can be seen in particular in FIG. 14 that the nozzles 6' in the lateral wings of the housing, that is to say the nozzles 6' which are remote from the center of the housing 1', are spaced apart from one another by a greater distance than the nozzles 6' in the center of housing. The number of nozzles arranged per square centimeter in the center of the housing is almost double that in the lateral portions (wings) of the housing 1'. This means that the water jet which exits in the center when the housing wings are shut off is very intense and can reliably rinse off soap or shampoo.

Figure 15:
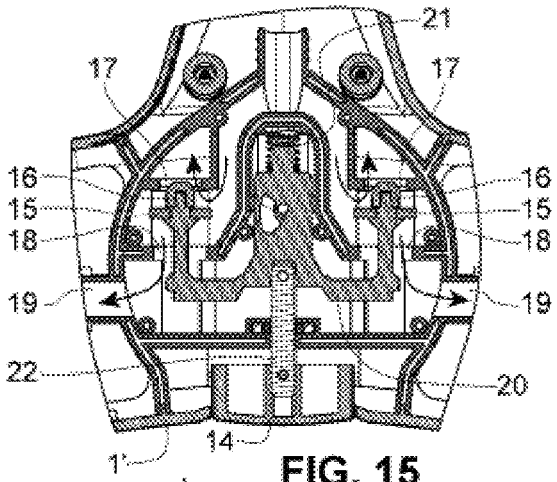
FIG. 15 shows a sectional plan view of the shower head from FIG. 13 with the shut-off device open.
Figure 16:
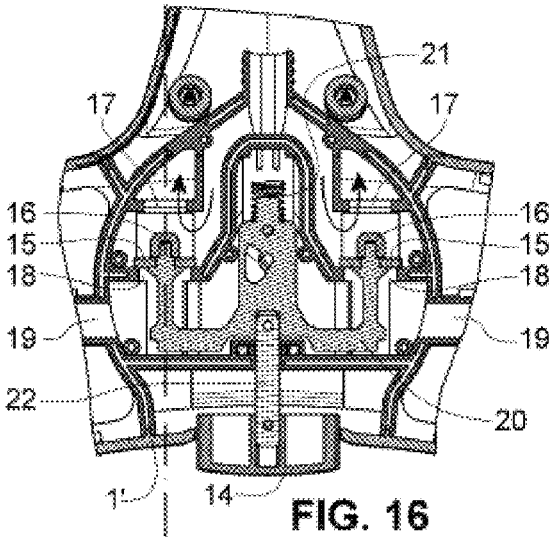
FIG. 16 shows an illustration, corresponding to FIG. 15, of the shower head with the shut-off device closed.
Figure 17:
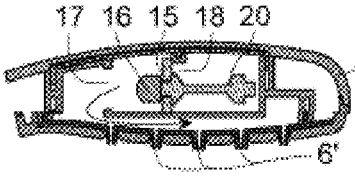
FIG. 17 shows a sectional side view of the shower head from FIG. 16.

In the embodiment of FIGS. 13 to 17, the flow of water is switched over by a contact slide 14. The contact slide 14 can be pushed into the housing 1', in the direction of the connector 2', in the manner of a pushbutton. As FIGS. 15 and 16 show, the contact slide 14 is connected to a shut-off body 20 via a coupling element 22. Opposite the contact slide 14, a return spring 21 acts against the shut-off body 20. The return spring 21 pushes the shut-off body in the direction of the contact slide 14. A latching mechanism (not illustrated), which acts in a manner similar to the latching mechanism of a ballpoint pen, defines two latching positions of the contact slide 14 and thus of the shut-off body 20. The first latching position is shown in FIG. 15. Here, the contact slide 14 has been pushed into the housing 1' and the shut-off body 20 allows the flow of water to all the nozzles 6' of the shower head. FIG. 15 shows that the shut-off body 20 has two lateral arms, each with a sealing ring 15 and a sealing stub 16 at the end thereof. A first flow cross section 17, which leads to the central nozzles 6', is open in the two latching positions of the shut-off body 20. A second flow cross section 18, which leads to the lateral nozzles 6', is fully open in the first switching position (FIG. 15) and fully closed, by the sealing ring 15, in the second switching position (FIG. 16). Consequently, in the second switching position (FIG. 16), the sealing ring 15 shuts off the flow of water to the lateral regions of the housing 1'.

It can be seen in FIGS. 15 and 16 that the flow of water to the lateral regions of the housing takes place, on the one hand, around elongate arms of the pressure-exerting body 20 and, on the other hand, through a relatively thin tube 19. This results in the flow of water to the lateral regions of the housing 1' being throttled. In order that, when the second flow cross sections 18 are open, the flow to the central nozzles 6' is not very much more intense than the flow to the lateral nozzles, the sealing stubs 16, in the first switching position, project into the first flow cross section and partially close the latter. As a result, the open surface area of the first flow cross section 17 is reduced and the flow through this flow cross section 17 is throttled. This gives rise to an essentially uniform flow through the nozzles 6' in the lateral regions of the housing 1' and the nozzles 6' in the center of the housing 1'.

The pushbutton-like actuation of the contact slide 14 renders the operation of this shut-off device extremely simple, and therefore a person who is taking a shower can operate the shut-off device reliably with wet hands, even if his eyes are closed.

LIST OF DESIGNATIONS

1,1' housing
2,2' connector
3 external thread
4 water line
5 diffuser
6,6' nozzle
7 water jet
8 person
9 manually actuable lever
10 bell
11 window
12 through-channel
13 inflow opening
14 contact slide
15 sealing ring
16 sealing stub
17 first flow cross section
18 second flow cross section
19 side channel
20 shut-off body
21 return spring
22 coupling element

The invention claimed is:

1. A shower head comprising a single rigid housing (1,1'), wherein the rigid housing (1,1') has a connection for a water line (4), the rigid housing (1,1') has at least one water flow channel connected to the water line (4), the water flow channel opens out into nozzles (6,6'), the nozzles (6,6') are arranged on a side of the rigid housing (1,1') which is oriented downward during use, the nozzles (6,6') have water jets exiting therethrough, the rigid housing (1,1') has an elongate flat shape, the nozzles (6,6') are distributed essentially over an entire length of the rigid housing (1,1'), the rigid housing is assigned a manually actuable shut-off device, the flow of water to some of the nozzles (6,6') is capable of being interrupted by means of the shut-off device, and wherein:

the rigid housing (1,1') comprises central nozzles (6,6') which are designed such that they cannot be closed and lateral nozzles which are remote from the center of the rigid housing and are designed in a closable manner, the manually actuable shut-off device is arranged on the rigid housing (1,1'), the manually actuable shut-off device has two switching positions, the shut-off device, in a first switching position, releases the flow of water to all the nozzles (6,6') of the rigid housing, the shut-off device, in a second switching position, interrupts the flow of water to the lateral nozzles (6,6') which are remote from the center of the rigid housing (1,1'), and At least two flow cross sections (17,18) are arranged inside the rigid housing, wherein the water flows through at least one first flow cross section (17) to the nozzles (6') which are arranged in the center of the rigid housing and flows through at least one second flow cross section (18) to the nozzles (6') which are remote from the center of the rigid housing (1'), and wherein the shut-off device, in the second switching position, closes the at least one second flow cross section (18).

2. The shower head as claimed in claim 1, wherein the nozzles (6,6') are arranged along a curved center line.

3. The shower head as claimed in claim 1, wherein the side of the rigid housing (1,1') which is oriented downward during use has a curved center line.

4. The shower head as claimed in claim 1, wherein the shut-off device, in the first switching position, partially closes the at least one first flow cross section (17) and releases the at least one second flow cross section (18).

5. The shower head as claimed in claim 1, wherein the shut-off device has a contact slide (14) capable of being displaced counter to a return spring and, in the case of the contact slide (14) being subjected to a first push, remains in a first latching position and, in the case of the contact slide (14) being subjected to a second push, remains in a second latching position, wherein the contact slide (14), in its first latching position, moves the shut-off device into the first switching position and, in its second latching position, moves the shut-off device into the second switching position.

6. The shower head as claimed in claim 1, wherein the rigid housing has at least one of the following features:

a connection for the water line (4) is arranged in the center of the rigid housing;

a fastening means of the rigid housing (1,1') is arranged in the center of the rigid housing; or the number of nozzles (6') which are arranged in the center of the rigid housing is greater, per unit of surface area, than the number of nozzles (6') which are remote from the center of the rigid housing (1').

7. The shower head as claimed in claim 1, wherein the connection for the water line (4) is a connector (2) provided with an external thread (3), wherein the external thread (3) serves, at the same time, as fastening means of the housing (1,1').

8. The shower head as claimed in claim 1, wherein a plurality of diffusers (5) are arranged on the underside of the rigid housing (1,1'), along a center line, each having a plurality of through holes which form the nozzles (6,6').

9. The shower head as claimed in claim 8, wherein each diffuser (5) is constructed so as to generate a conically diverging water jet made up of a plurality of individual jets.

10. The shower head as claimed in claim 1, wherein a slide shuts off the water flow channels leading to the lateral nozzles.

11. The shower head as claimed in claim 10, wherein the slide encloses a central diffuser in annular fashion and, in a first rotary position, shuts off the water flow channels leading to the lateral nozzles and, in a second rotary position, releases the same.

12. The shower head as claimed in claim 1, wherein the rigid housing (1,1') is produced by injection molding from plastics material or metal.

* * * * *